United States Patent [19]

Fehrer et al.

[11] 4,109,454

[45] Aug. 29, 1978

[54] APPARATUS FOR TWISTING TEXTILE FIBERS

[75] Inventors: Ernst Fehrer; Franz Konig, both of Linz, Austria

[73] Assignee: Dr. Ernst Fehrer Gesellschaft m.b.H. & Co. K.G. Textilmaschinenfabrik u. Stahlbau, Linz, Austria

[21] Appl. No.: 803,227

[22] Filed: Jun. 3, 1977

[30] Foreign Application Priority Data

Jun. 21, 1976 [AT] Austria ..... 4513/76

[51] Int. Cl.[2] ..... D01H 1/12

[52] U.S. Cl. ..... 57/58.95; 57/58.89

[58] Field of Search ..... 57/5, 58.89–58.95

[56] References Cited

U.S. PATENT DOCUMENTS

| | | | |
|---|---|---|---|
| 3,768,243 | 10/1973 | Brown et al. | 57/58.89 |
| 3,913,310 | 10/1975 | Fehrer | 57/58.89 X |
| 3,972,173 | 8/1976 | Fehrer | 57/58.89 |
| 3,981,137 | 9/1976 | Fehrer | 67/58.89 X |
| 4,028,871 | 6/1977 | Aschenbrenner | 57/58.89 |
| 4,051,653 | 10/1977 | Mittregger | 57/58.89 |

*Primary Examiner*—Richard C. Queisser
*Assistant Examiner*—Charles Gorenstein
*Attorney, Agent, or Firm*—Kurt Kelman

[57] ABSTRACT

Two closely spaced apart, perforated suction drums are provided, which have parallel axes and confronting peripheral surface portions defining between them a region which is triangular in cross-section and adapted to receive fibers flying through a flight region which precedes said triangular region in a direction that is transverse to said axes. Suction means are operable to provide a suction zone in each of said confronting peripheral surface portions. Said drum are operable to rotate in the same sense so that fibers received in said triangular region and attracted to said suction zones by the operation of said suction means are twisted together by said drums to form a yarn. Yarn-withdrawing means are operable to withdraw said yarn from said triangular region toward one end thereof while holding said yarn against rotation. A throwing member is operable to move in said flight region toward said one end thereof in a plane which is transverse to said direction.

9 Claims, 2 Drawing Figures

APPARATUS FOR TWISTING TEXTILE FIBERS

BACKGROUND OF THE INVENTION

Figure 1:
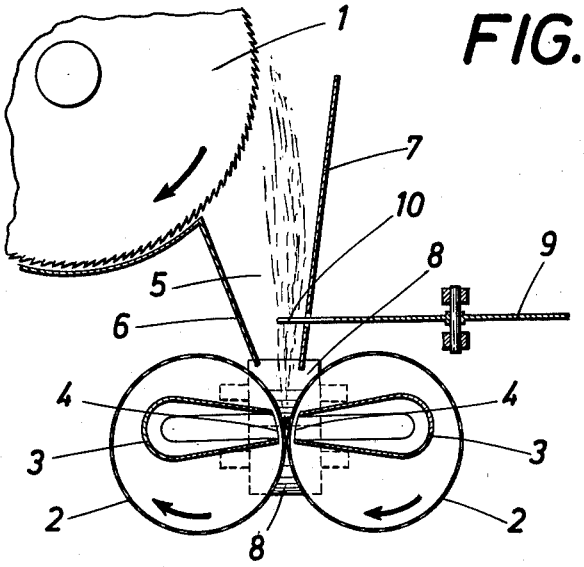

This invention relates to apparatus for spinning textile fibers comprising two closely spaced apart, perforated suction drums, which rotate in the same sense and define between them a triangular region, which is adjoined by the suction zones, which face each other, in which apparatus the fibers are received in a flying state by the triangular region and are twisted together therein to form a yarn, which is withdrawn toward one end of the drums and is held against rotation at the same time.

Such apparatus is known, e.g., from Opened German Specification No. 2,449,583. It has been found that it would be desirable to supply the fibers which fly into the triangular region between the suction drums in such an orientation that said fibers are as nearly parallel to each other as possible and extend in the direction in which the yarn is withdrawn because the fibers would then be twisted together in linear contact with each other whereas fibers which cross each other are twisted together only in point contact with each other. A twisting of fibers in linear contact with each other results in a more coherent yarn and is opposed by a smaller resistance so that the yarn can be withdrawn at higher speed. Whereas the simplest and most favorable mode of supplying the fibers is to cause them to fly from a horizontal carding drum, as has been disclosed, e.g., in Opened German Patent Specification No. 2,361,313, in that case the desired parallel orientation of the fibers during the formation of the yarn cannot be accomplished.

When fibrous feed material is disintegrated by a carding drum, the fibers at the periphery of the carding drum will have an orientation transverse to the axis of the drum. This orientation is inherently unfavorable for the subsequent spinning. As the fibers fly from the carding drum into the triangular region between the suction drums, the fibers change their orientation in quite different ways so that part of the fibers enter the triangular region with an orientation which is parallel to the direction in which the fibers are withdrawn, another part of the fibers are oriented transversely to that direction, and a still further part are oriented at different oblique angles to the direction in which the yarn is withdrawn when the fibers reach the actual spinning region.

For this reason it is an object of the invention so to improve the apparatus which has been described first hereinbefore that a yarn can be manufactured which is more uniform and has a higher tenacity and can be withdrawn at a higher speed.

This object is accomplished according to the invention in that a throwing member is disposed in the flight region flown through by the fibers, which flight region is preferably defined by guide walls, and said throwing member is movable toward the yarn-withdrawing means in a plane that is transverse to the flight direction of the fibers.

The fibers which fly from the carding drum into the triangular region between the suction drums impinge on the throwing member, which imparts to the fibers a momentum toward the yarn-withdrawing means so that the fibers are deflected in the desired sense, regardless of the orientation in which they impinge on the throwing member, and the fibers have a substantially parallel orientation as they enter the zone in which the yarn is actually formed. As a result, the fibers have in the triangular region between the suction drums an orientation which is much more favorable than before so that the fibers in the yarn are not only in point contact but contact each other in a larger length. As a result, the coherence and with it the tenacity of the yarn is improved, the resistance to twisting presented by the fibers is reduced and, consequently, the yarn can be withdrawn at higher speed. Besides, the throwing member causes the fibers to be distributed in the triangular region over a larger length in the direction in which the yarn is withdrawn than in the previous practice so that a more uniform yarn results.

In an arrangement which is particularly simple and suitable and can easily be embodied, the throwing member consists of a rotating throwing disc and only a peripheral segment of said disc protrudes into the region flown through by the fibers. It will be understood that fibers impinging on a rotating disc will fly in a tangential direction from said disc. Because the fibers impinge on the disc only in a segmental area, the tangential direction differs only slightly from the direction in which the yarn is withdrawn. Instead of a rotating throwing member, a member which moves along a straight line at least in the flight region flown through by the fibers could be used and could consist e.g., of one course of an endless chain or endless belt and may be provided with flights which extend into the flight region.

To increase the intended action of the throwing disc, the same may be serrated at its periphery, preferably by a provision of saw teeth. If the root circle of such throwing disc remains outside the flight region flown through by the fibers, the flying fibers approaching the disc will strike only on the teeth and will be thrown off with an increased momentum from the sides of the teeth.

Figure 2:
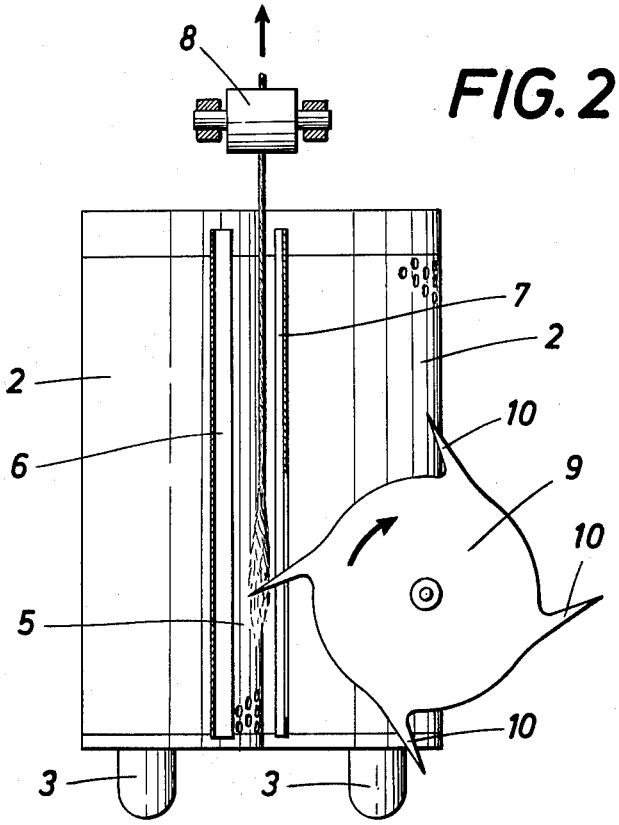

An embodiment of the invention is shown strictly diagrammatically and by way of example on the accompanying drawing, in which FIG. 1 is a vertical transverse sectional view showing the essential parts of an spinning apparatus and FIG. 2 is a horizontal sectional view taken on a plane in which the throwing disc is disposed.

Fibrous material is fed to a serrated carding drum 1, from which individual fibers fly freely into a triangular region between two closely spaced apart, perforated suction drums 2, which rotate in the same sense and are provided each with a suction insert. The two suction inserts 3 define confronting suction zones 4 adjoining the triangular region. The flight region 5 through which the fibers fly from the carding drum 1 into the triangular region between the two suction drums is defined by guide walls 6, 7. A pair of rolls 8 are provided at one end of the suction drums 2 and serve to withdraw the resulting yarn and to hold it against rotation at the same time.

According to the invention, a throwing disc 9 is provided, which rotates in a plane that is transverse to the flight direction of the fibers. Only a peripheral segment of the rotating disc extends into the flight space 5 for the fibers. The disc 9 is provided at its periphery with saw teeth 10. The throwing disc rotates in such a manner that the teeth 10 move toward the withdrawing rolls in the flight region 5 flown through by the fibers. As is apparent from FIG. 2, the root circle of the throwing disc 9 is disposed outside the flight region 5 flown through by the fibers and outside of the guide wall 7.

What is claimed is:

1. Apparatus for spinning textile fibers,
comprising two closely spaced apart, perforated
suction drums having parallel axes and confronting peripheral surface portions defining between them a region which is triangular in cross-section and adapted to receive fibers flying through a flight region which precedes said triangular region in a direction that is transverse to said axes,
suction means operable to provide a suction zone in each of said confronting peripheral surface portions,
said drums being operable to rotate in the same sense so that fibers received in said triangular region and attracted to said suction zones by the operation of said suction means are twisted together by said drums to form a yarn,
said apparatus comprising further
yarn-withdrawing means operable to withdraw said yarn from said triangular region toward one end thereof while holding said yarn against rotation, and
a throwing member which is operable to move in said flight region toward said one end thereof in a plane which is transverse to said direction.

2. Apparatus as set forth in claim 1, which comprises fiber-delivering means for causing delivering fibers to fly in said direction into said flight region.

3. Apparatus as set forth in claim 2, in which said flight region is defined on opposite sides thereof by two spaced apart guide walls which are disposed between said fiber-delivering means and said triangular region and extend parallel to said axes and toward said triangular region.

4. Apparatus as set forth in claim 1, in which said flight region is defined on opposite sides thereof by two spaced apart guide walls which extend parallel to said axes and toward said triangular region.

5. Apparatus as set forth in claim 1, in which said throwing member consists of a disc which is rotatable to dispose only a peripheral segment of the rotating disc in said flight region.

6. Apparatus as set forth in claim 5, in which said flight region is defined on opposite sides thereof by two spaced apart guide walls which are disposed between said fiber-delivering means and said triangular region and extend parallel to said axes and toward said triangular region.

7. Apparatus as set forth in claim 5, in which said disc is formed with teeth at its periphery.

8. Apparatus as set forth in claim 7, in which said teeth define a root circle and said disc is disposed so that said rooth circle is disposed entirely out of said flight region.

9. Apparatus as set forth in claim 8, in which said flight region is defined on opposite sides thereof by two spaced apart guide walls which are disposed between said fiber-delivering means and said triangular region and extend parallel to said axes and toward said triangular region.

* * * * *